US007134949B2

(12) United States Patent
Nomoto et al.

(10) Patent No.: US 7,134,949 B2
(45) Date of Patent: Nov. 14, 2006

(54) CONSTANT ANGULAR GRINDING TOOL

(75) Inventors: Nobutoshi Nomoto, Ebina (JP); Shin Oshima, Ebina (JP); Naohisa Takahashi, Wyckoff, NJ (US)

(73) Assignees: Sankyo Diamond Industrial Co., Ltd., Ebina (JP); NAO Enterprise Inc., Wyckoff, NJ (US)

( * ) Notice: Subject to any disclaimer, the term of this patent is extended or adjusted under 35 U.S.C. 154(b) by 0 days.

(21) Appl. No.: 11/107,869

(22) Filed: Apr. 18, 2005

(65) Prior Publication Data

US 2005/0250429 A1 Nov. 10, 2005

(30) Foreign Application Priority Data

Apr. 27, 2004 (JP) ..... 2004-130662

(51) Int. Cl.
*B24B 49/00* (2006.01)

(52) U.S. Cl. ..... 451/358; 451/344; 451/359

(58) Field of Classification Search ..... 451/344, 451/353, 356–357, 359, 360, 391
See application file for complete search history.

(56) References Cited

U.S. PATENT DOCUMENTS

| | | | | |
|---|---|---|---|---|
| 3,517,462 A | | 6/1970 | Imhof | |
| 3,594,958 A | * | 7/1971 | Cusumano | 451/358 |
| 5,138,735 A | * | 8/1992 | Kusz et al. | 15/97.1 |
| 5,394,652 A | | 3/1995 | Casillas et al. | |
| 5,476,410 A | | 12/1995 | Lupi | |
| 5,662,515 A | * | 9/1997 | Evensen | 451/59 |
| 5,842,250 A | * | 12/1998 | Zhadanov | 15/230.14 |
| 6,110,027 A | * | 8/2000 | Muller | 451/359 |
| 6,116,996 A | * | 9/2000 | Yanase | 451/359 |
| 6,435,951 B1 | * | 8/2002 | Ishizaka | 451/66 |
| 6,676,498 B1 | * | 1/2004 | Smith | 451/344 |
| 2005/0250429 A1 | * | 11/2005 | Nomoto et al. | 451/359 |

FOREIGN PATENT DOCUMENTS

| | | |
|---|---|---|
| EP | 0 881 048 A1 | 12/1998 |
| JP | 2001-300855 | 10/2001 |
| JP | 2002-205274 | 7/2002 |

* cited by examiner

*Primary Examiner*—Lee D. Wilson
(74) *Attorney, Agent, or Firm*—Oblon, Spivak, McClelland, Maier & Neustadt, P.C.

(57) ABSTRACT

A constant angular grinding tool comprising: a profile wheel whose grinding face is fixed at an inclination angle with respect to the axis of a spindle of a rotary electric tool; a first guide plate which is a disc member attached rotatably to a spindle between the profile wheel and the rotary electric tool so as to guide for a grinding direction by bringing the edge of the disc member into a contact with the reference level of a material; and a second guide plate which is a disc member attached rotatably to a spindle between the profile wheel and the first guide plate and whose outer peripheral end face makes contact with the edge of the material to control a grinding distance from the edge.

6 Claims, 6 Drawing Sheets

CONSTANT ANGULAR GRINDING TOOL

TECHNICAL FIELD

The present invention relates to a constant angular grinding tool preferably used for grinding the edge of stone or the like at a constant angle and more particularly to a constant angular grinding tool having a guide function capable of grinding the edges of sheet materials accurately at a proper angle, specifically, at an angle of 45° in order to apply the sheet materials to a wall face at right angle with an accurate butting surface, when carrying out exterior construction work on an existing wall with those sheet materials such as tiles, natural stones represented by granite or marble or engineered stones.

BACKGROUND ART

Conventionally, as the exterior construction material used for covering an existing wall surface, various kinds of fired tiles, various kinds of natural stones, engineered stones and the like (hereinafter, referred to as "material" or "module tile" depending on a situation) have been generally used. As the tile material as construction material, as shown in FIG. 9, square JIS standard tile materials 7–13 mm in thickness and 300 mm long square or 600 mm long square, and processed materials of various shapes such as long-size tiles and small-size tiles have been marketed and the surface of the tile is subjected to coating with glaze and the porcelain tile and the natural and engineered stone is polished. When using as for example, the wall materials on construction site, generally, a method of bonding its rear surface 73 to the wall surface while butting its edge to an existing wall surface so as to secure a predetermined area has been used. However, when treating a right angle wall surface, that is, a corner portion 91 of the existing wall surface by butting two tile sheets, if the butting angle, more specifically, an inclination angle of 45° and an inclined face (slope) are not formed accurately, there occurs a large deflection in the butting face, so that no straight wall surface can be obtained, thereby possibly inducing critical damage to the quality of finished surface (see FIG. 8).

Although the exterior construction material represented by the tile material has attracted public popularity in terms of its finished luxurious appearance and excellent heat insulation effect, it has been widely prevalent as an exterior construction material for the wall surface. However, because its base material is a specific hard brittle material, originally, its processibility is very poor and various cares have been paid to even straight cutting work. As a disc like diamond cutter for cutting, for example, a porcelain tile, a so-called rim type diamond saw blade in which diamond abrasive portions 3 mm in thickness are provided continuously on the outer peripheral face of a relatively large substrate has been proposed, the diamond saw blade being capable of cutting without scattering of tile glaze or chipping by providing right and left edge portions of the grinding stone portion alternately with a cut-out groove having a width ½ the thickness of the grinding stone portion in proportion to the thickness of the grinding stone portion (see, for example, Japanese Patent Application Laid-Open No. 2001-300855). Further, as the disc like diamond cutter for cutting the porcelain tile, there has been proposed a cutter in which the stiffness of its substrate is intensified by forming the substrate on an outer portion slightly thinner than the diamond abrasive chip layer formed on the outer peripheral face of the substrate while forming a substrate portion in the center of the substrate thicker than the outer portion of the substrate, so as to prevent deformation of the substrate, thereby blocking hand movement originating therefrom to realize precision cutting of the porcelain tile (see for example, Japanese Patent Application Laid-Open No. 2002-205274). A number of proposals have been made and realized for practical application.

Although the processing of the tile material require the above-described care for even cutting along a simple straight line, the side face processing of executing exterior construction by abutting two tile materials on a right angle corner of the existing wall from both sides requires extremely high skill. Thus, conventionally, this work depends upon the skilled engineer specialized in such a edge processing or a tile material in which an inclination angle of 45° is formed on the edge of a tile material is manufactured by means of a special machine for the edge processing developed by a edge processing manufacturer (tile bonding processing manufacturer) or the corner piece material 91 shown in FIG. 10 is manufactured and sold to a construction worker as special product. In FIG. 10, reference numeral 92 denotes a tile material.

However, it cannot be denied that such construction work in this industry includes makeshift factors and it is more difficult than expected to purchase the tile materials whose edges are processed to 45° or the corner piece materials 91 in a sufficient quantity in order to apply them to actual construction. Further, because it is necessary to depend on the processing of subcontractor by, for example, booking him for the processing, a large burden is induced in a serious price competition and there are unstable factors from viewpoints of due date. Thus, although a method of carrying out exterior construction by the means shown in FIG. 11 has been tried, in this case, the wall surface is coated and/or polished in conditions in which a edge 932 not treated of the tile material 93 is exposed outside and because this provides a strange contrast with the tile material surface 931 subjected to coating with glaze or polishing, a further special processing is required for correcting it so that not only the finished face quality drops but also the processing cost can be raised largely.

Although any grinding tool having a function for blocking hand movement has been proposed and a tile material and corner piece material 91 whose edge is preliminarily processed to 45° have been manufactured and marketed and further, it has been confirmed that specialized processing subcontractors exist, it is more difficult than expected to estimate the tile materials and corner piece materials 91 for use accurately and purchase, and complete a construction using them without any insufficiency. Often those components are purchased more than a necessary amount thereby leading to increase in cost or the necessity of making additional order occurs during construction leading to a cause for delay of the due date. Further, making orders to such specialized subcontractor itself becomes an excessive burden, and therefore, this is an important problem which is desired to be solved soon.

Accordingly, in views of the current situation of exterior wall construction with such tile materials and the like, an object of the present invention is to provide a grinding tool which is capable of starting processing work immediately on construction site and requires no special skill, thereby enabling grinding of the edge processing easily and accurately with a specified angle, more specifically, an angle of 45° just by simple manual work by average-skilled workers.

DISCLOSURE OF THE INVENTION

That is, the present invention (1) provides a constant angular grinding tool comprising: a profile wheel whose grinding face is formed with a predetermined inclination angle X with respect to the axis of a spindle of a rotary electric tool; a first guide plate which is a disc member attached rotatably to a spindle between the profile wheel and the rotary electric tool so as to guide for a grinding direction by bringing the side face of the disc member into a contact with the reference level of a material to control the inclination angle X; and a second guide plate which is a disc member attached rotatably to a spindle between the first guide plate and the profile wheel and whose outer peripheral end face makes contact with the edge of the material to control a grinding distance Y from the side face, wherein the profile wheel, the first guide plate and the second guide plate are fixed to the spindle of the rotary electric tool with a lock nut such that they are perpendicular thereto.

Further, the present invention (2) provides the constant angular grinding tool in which the first guide plate is a disc member having a bearing fitting hole in the center thereof and larger than the maximum diameter of the grinding face of the profile wheel and mounting thereof to the spindle of the rotary electric tool is carried out through a first bearing fitted to the bearing fitting hole.

Still further, the present invention (3) provides the constant angular grinding tool in which the second guide plate is a disc member having a bearing fitting hole in the center thereof and having an outside diameter substantially equal to the minimum diameter of the profile wheel and mounting thereof to the spindle of the rotary electric tool is carried out through a second bearing fitted to the bearing fitting hole.

Further, the present invention (4) provides the constant angular grinding tool in which the grinding face of the profile wheel is formed at an inclination angle of 45° with respect to the axis of the spindle of the rotary electric tool and super abrasive portion composed of CBN abrasive brazing or diamond abrasive brazing is formed on the grinding face.

Still further, the present invention (5) provides the constant angular grinding tool in which a planarity of cut-out portions are formed radiantly in the abrasive brazing portion of the profile wheel from the axis to the outer periphery.

In addition, the present invention (6) provides the constant angular grinding tool in which the first guide plate and second guide plate are manufactured of metal, resin or composite material thereof.

Yet still further, the present invention (7) provides the constant angular grinding tool in which the material is a square sheet material, such as a tile, natural stone or engineered stone.

Yet still further, the present invention (8) provides the constant angular grinding tool in which flow paths for grinding fluid supplied to the grinding face of the profile wheel are provided in a contact face of the profile wheel to the second guide plate.

By using the constant angular grinding tool of the present invention, for example, the edges of materials composed of two tiles or the like are ground at a predetermined inclination angle X from the end face of the surface of the material to the rear face and at a predetermined distance Y from the edge of the material inwardly, so that when butting the ground faces, a right angle corner can be formed with the two tile materials. When the material side face is ground at 45° using the constant angular grinding tool, the edge of a first guide plate is brought into a contact with the reference level (surface) of the material at the start of the grinding or in a process of the grinding for a guide in order to maintain a horizontality with respect to the reference level of the material. Thus, even a unskilled and relatively inexperienced worker can handle an electric tool rotating at high speeds easily and continue a grinding work to the edge with safety. On the other hand, because the outer peripheral end face of the second guide plate makes a contact with the edge of the material as the grinding progresses and the progress of the grinding is stopped so that a grinding distance (grinding depth) Y with reference to the edge of the material is controlled. As a consequence, the inclination angle of 45° and the inclined area (slope face) on the edge of the material are always controlled from the beginning to the end. The edges of the materials ground in this way form an accurate right angle by abutting both, so that the exterior construction at the right angle corner on an existing wall face can be implemented easily, accurately and effectively with manual work of an ordinary worker on construction site. Therefore the increase in cost due to excessive purchase of construction materials and delay of the due date originating from supplementary purchase of the materials are eliminated preliminarily, and the burden of relying on making orders to any specialized subcontractor can be removed. Further, accurate construction by adjustment just on site can be implemented effectively with resource saving and at low cost. Further, by changing the inclination angle X of the grinding surface of the profile wheel to a desired angle X1, the side face processing can be executed not only at right angle but at a different angle, so that this is expected to be applied to wide applications.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE INVENTION

Figure 1:
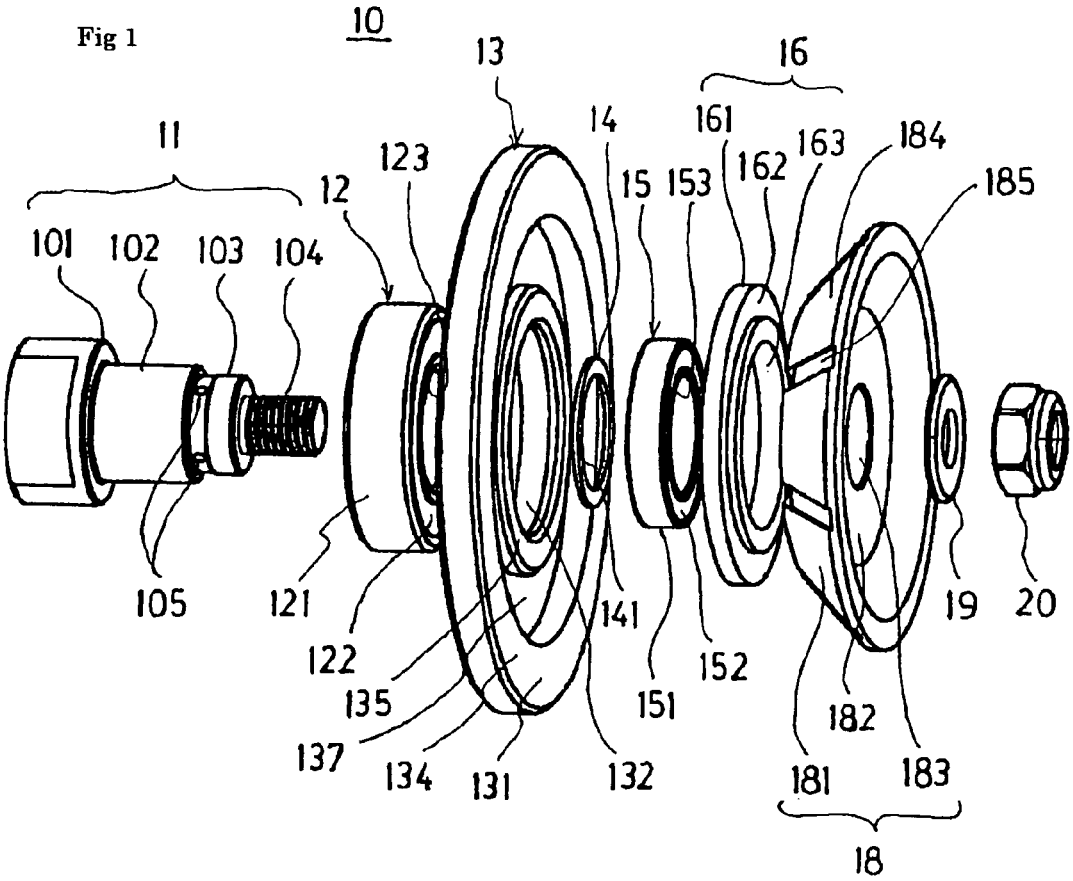
FIG. 1 is a disassembly perspective view of a constant angular grinding tool of this embodiment as seen from its front end (opposite side to an electric tool)
Figure 2:
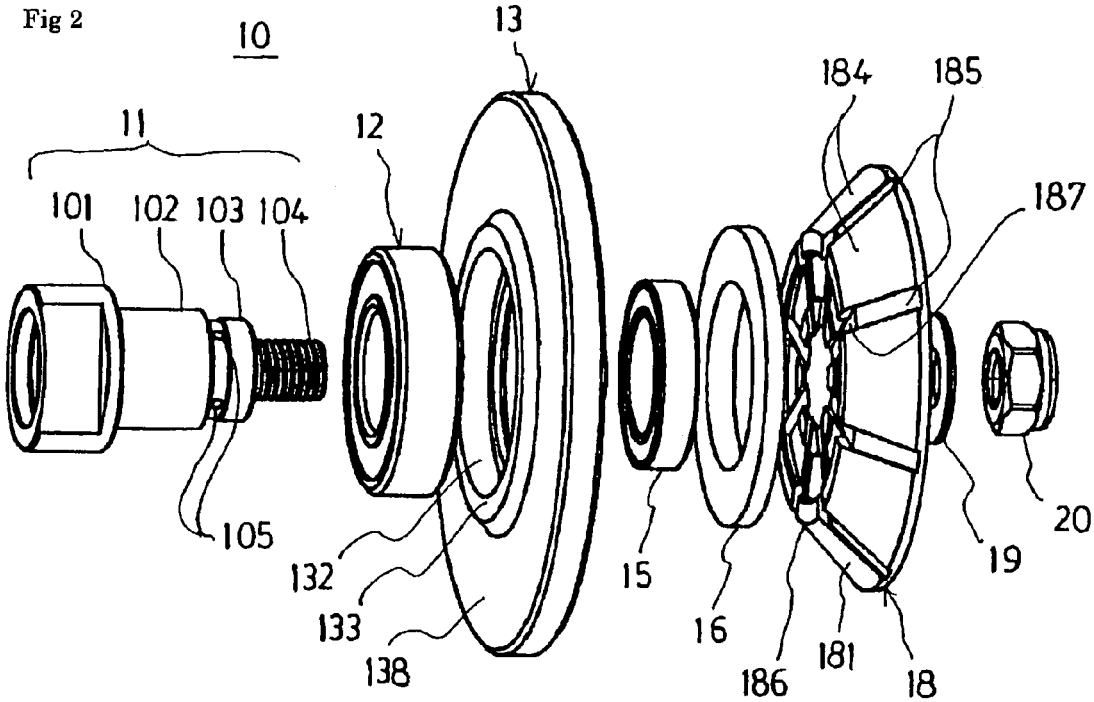
FIG. 2 is a disassembly perspective view of the constant angular grinding tool of this embodiment as seen from the electric tool side.
Figure 3:
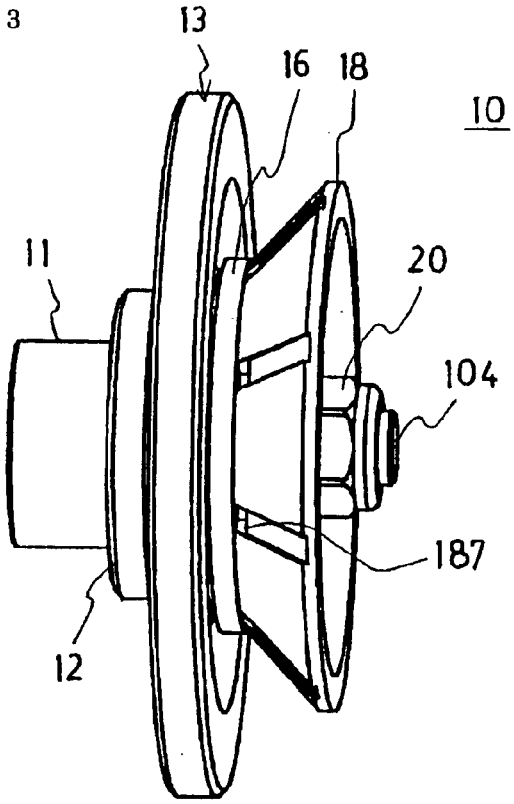
FIG. 3 is a perspective view of the constant angular grinding tool of this embodiment as seen from its front end.
Figure 4:
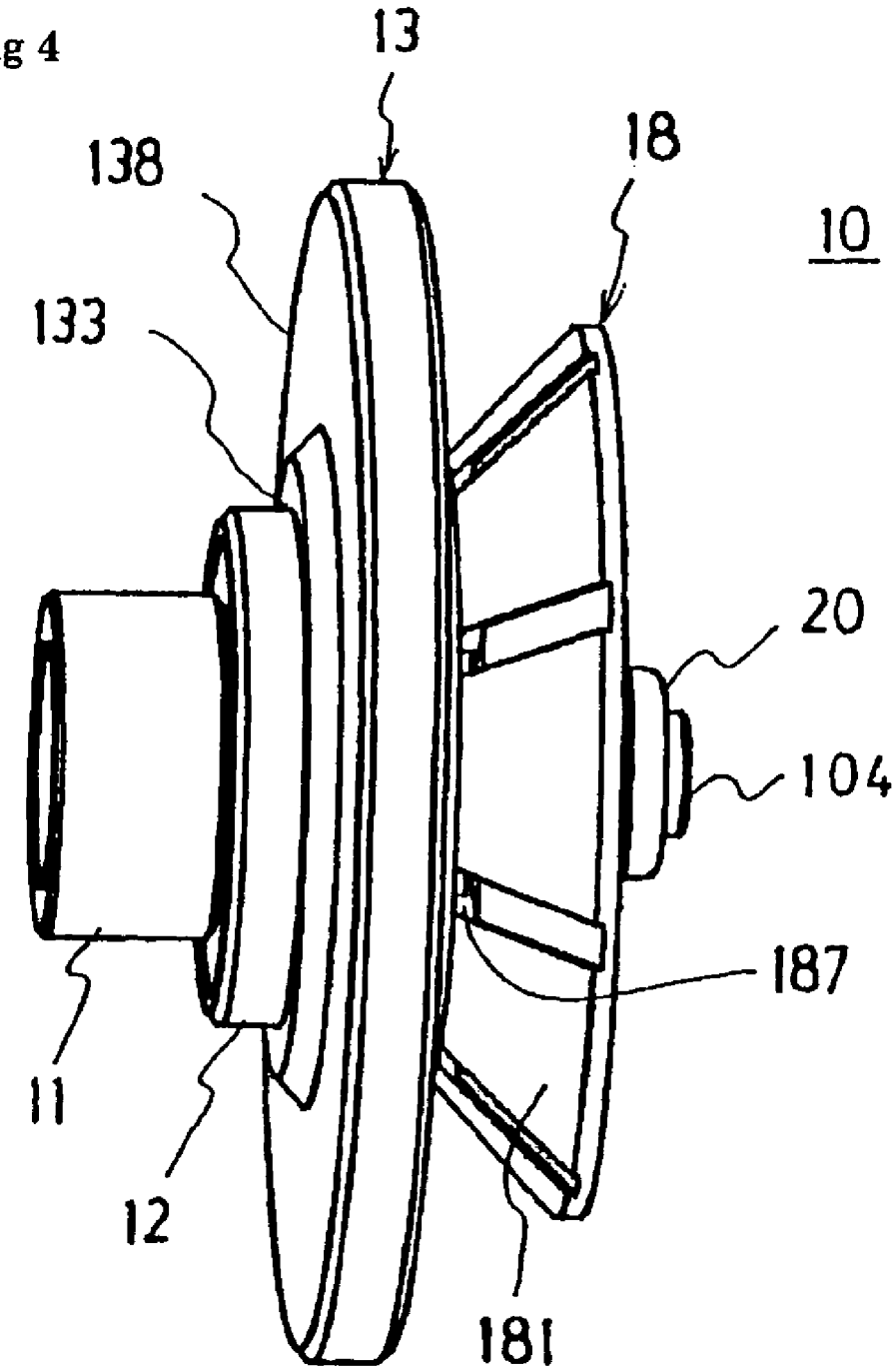
FIG. 4 is a perspective view of the constant angular grinding tool of this embodiment as seen from the electric tool side.
Figure 5:
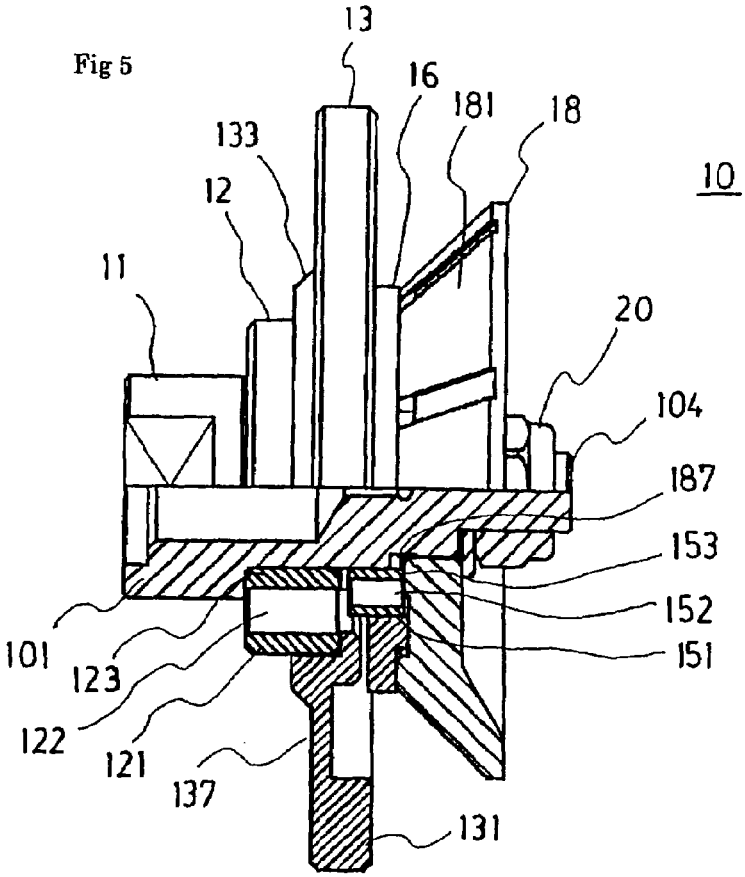
FIG. 5 is a side view showing part of the constant angular grinding tool of this embodiment with its section.

Next, the constant angular grinding tool 10 of the embodiment of the present invention will be described with reference to FIGS. 1 to 9. In the meantime, a description of the rotary electric tool is omitted in the same Figures.

In the constant angular grinding tool of this embodiment a profile wheel 18 having a substantially trapezoidal section is fixed to a spindle 11 of a rotary electric tool (not shown) by tightening a lock nut 20. The grinding face 181 of the profile wheel 18 is formed with an inclination angle X of 45° with respect to the axis of the spindle 11 of the aforementioned rotary electric tool. Grinding stone sections 184 composed of mainly diamond abrasive brazing or CBN abrasive brazing is formed on the grinding face 181 of the profile wheel 18 and it is preferable to provide a planarity of cut-out grooves 185 radiantly in the direction to the outer periphery from the center of axes. As a consequence, discharge of cutting chips and cooling of the grinding stone section can be carried out effectively and biting of a blade into material is accelerated smoothly. As the rotary electric tool, hand-held rotary electric tools such as a disc grinder, sander and polisher can be mentioned.

A first guide plate 13 composed of a disc member in which a first bearing 12 is fitted freely and rotatably to an inside diameter portion thereof is mounted to the first spindle main body 102 of the rotary electric tool. As shown in FIG. 1, a through hole formed into two steps is provided in the first guide plate 13 and a large diameter section of the through hole constitutes a fitting hole 132 to which a first bearing 12 is fitted. A circular thick portion 135 around the fitting hole 132, a circular thin portion 137 located outside thereof and a flat circular guide portion 131 which is located further outside and whose side face directing to the profile wheel 18 are formed. In the first guide plate 13, by providing a thick portion 135 around the fitting hole 132 of its inside diameter portion, a wider contact area for contacting the first bearing 12 to be fitted is secured and the strength of the first guide plate 13 is intensified. On the other hand, by providing a circular thin portion 137 in the central portion adjacent to this, the weight of the first guide plate 13 is reduced. The through hole provided in the center of the first guide plate 13 of this embodiment is formed into two steps across the center in the axial direction of the maximum thickness of the first guide plate 13 and the large diameter section of the steps serves as the bearing fitting hole 132, to which the first bearing 12 is fitted. The first bearing 12 for use is not restricted to any particular type, but it is permissible to select an ordinary marketed bearing in which a planarity of steel balls 122 are loaded between for example, an outer wheel 121 and an inner wheel 123 appropriately. An inner wheel 123 of the first bearing 12 is fixed between the base portion 101 of a spindle 11 and a spacer 14 by tightening the lock nut 20. Because the outer wheel 121 of the first bearing 12 is fitted to the bearing fitting hole 132 of the first guide plate 13, the first guide plate 13 becomes free to a rotation of the spindle 11 of the rotary electric tool, thereby ensuring its free rotation.

Figure 6:
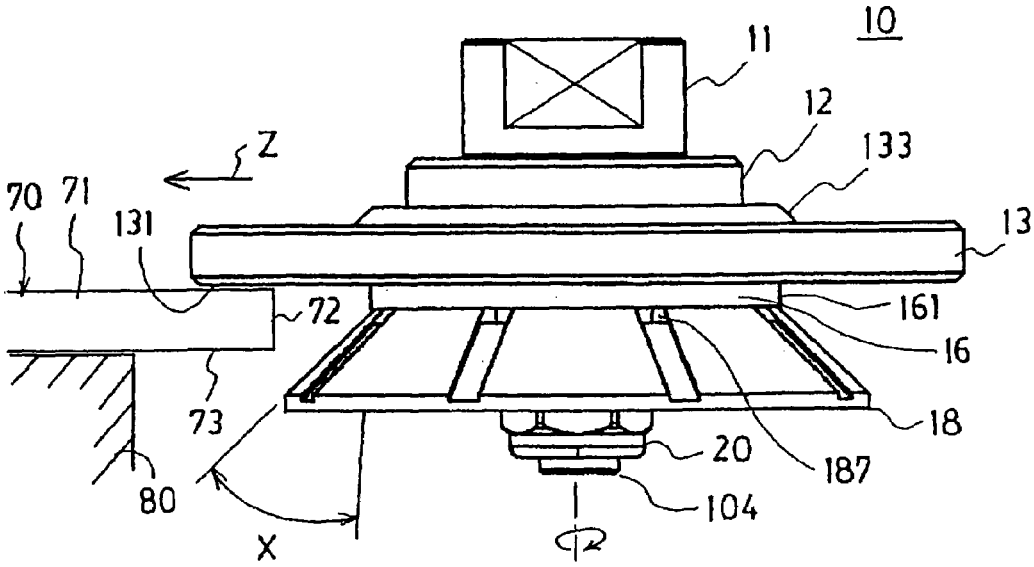
FIG. 6 is a diagram showing a state just before grinding work using the constant angular grinding tool of this embodiment.
Figure 7:
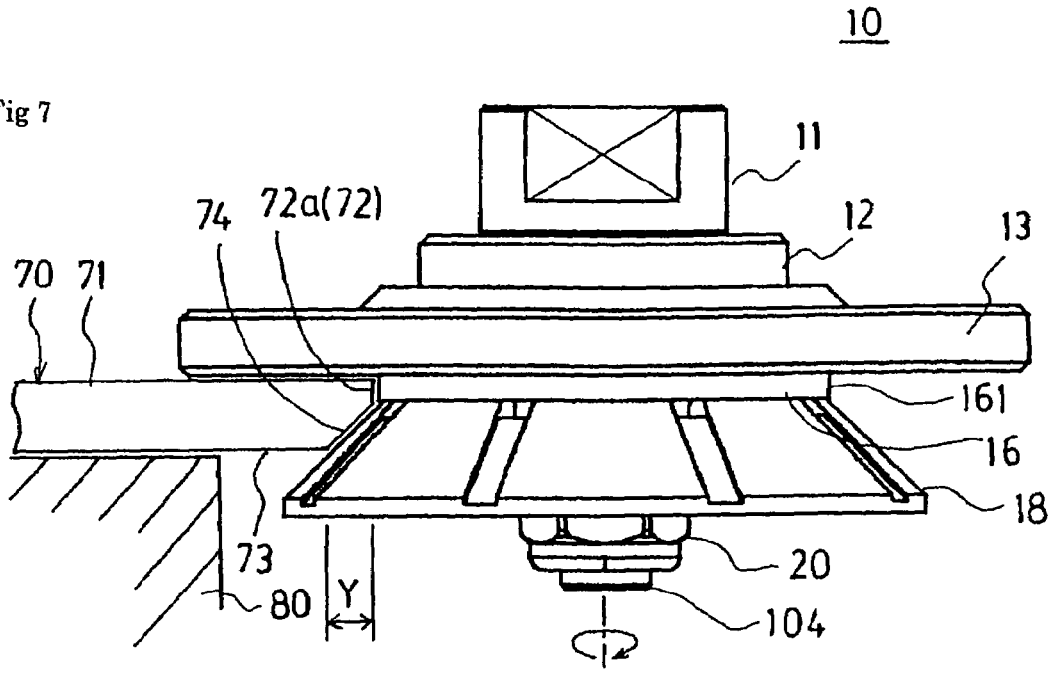
FIG. 7 is a diagram showing a state when the grinding work using the constant angular grinding tool of this embodiment is ended.

As for the first guide plate 13, when grinding the material edge, by bringing the flat outer peripheral edge 131 of the first guide plate 13 as shown in FIGS. 6 and 7 into a contact with the reference level of the material 70, that is, the face 71 of a tile material in this example, horizontality in the grinding direction is maintained so as to control a predetermined inclination angle X easily and as a consequence, a vibration induced by the electric tool which rotates rapidly is absorbed thereby contributing largely to prevention of hand movement. Although the first guide plate 13 is absolutely required to have a larger diameter than the maximum diameter of the grinding face of the profile wheel 18 and at the same time, a specified strength, it is preferred to be formed of relatively light weight metal, resin or composite material thereof selectively by taking the weight of the entire tool into account. More specifically, for example of metals, light metal such as magnesium and aluminum and the like and its alloys are preferable because they are relatively light, have specified heat resistance and stiffness and excellent processibility. Adopting various kinds of resins as material constituting the first guide plate 13 is preferable in that it never damages the surface 71 of tile material subjected to coating with glaze or polished. Further, as the composite material, fiber reinforced metal, heat resistant fiber reinforced resin and the like can be mentioned. The thickness of the thick portion of the first guide plate 13 is not restricted to any particular one but may be designed by taking into account the strength of material, the total weight of the tool and resonance accompanied by the rotation of the tool and usually, it is about 5–10 mm.

A second guide plate 16 composed of a disc member having a smaller diameter than the first guide plate 13 is mounted freely and rotatably on the first spindle main body 102 between the first guide plate 13 and the profile wheel 18. The second guide plate 16 has an fitting hole 163 in which the second bearing 15 is fitted to its inside diameter section in the same manner as the first guide plate 13 and when it is installed to the first spindle main body 102 through the second bearing 15 fitted to the fitting hole 163, a free state to the rotation of the spindle 11, so-called freely rotatable state is maintained.

The second guide plate 16 has a circular shapes, is located between the first guide plate 13 and the profile wheel 18 and is mounted on the first spindle main body 102 through the second bearing 15 so as to determine a grinding distance (grinding depth) from the edge (reference level) of the material 70 (see FIG. 7). As a result, the inclined area of a butting face when a right angle corner is constructed on an existing wall face, that is, slope face 74 is specified. Although the second guide plate 16 is desired to be formed thin ideally and eliminate a non-grinding remainder from the edge (reference level) 72 of the material 70 because it is nipped between the first bearing 12 and the profile wheel 18 so as to determine the distance Y, it needs to incorporate the second bearing 15 in order to keep itself free of the rotation of the spindle 11 and control a grinding distance favorably and thus, it needs to maintain a contact area to the second bearing 15 with a specified width. Thus, according to this embodiment, the inside diameter portion of the second guide plate 16, that is, the portion around the second bearing fitting hole 163 is formed thick and an outside disc portion 162 having an outer peripheral end face 161 having a guide function is formed as thin as possible so as to meet such a demand. In the meantime, the second guide plate 16 has a smaller diameter than the first guide plate 13 and the outside diameter thereof is substantially the sanie as the minimum diameter 186 of the grinding face of the profile wheel 18, and the thickness thereof is smaller than the first guide plate 13 and thus, a specified strength is required from the above-described reason. It is desired to be formed by selecting from relatively light weight metal, resin and composite material thereof like the first guide plate 13 considering the weight of the entire tool. In the second guide plate 16, when grinding the material edge 72, the outer peripheral end face 161 having the guide function approaches the edge 72 of the material 70, that is, in this example, the edge (reference level) of the tile material as the grinding progresses and the outer peripheral end face 161 makes contact with the edge 72 50 as to stop the progress of grinding, so that the grinding distance (grinding depth) Y is controlled securely. The second bearing 15, which is fitted into the bearing fitting hole 163 of the second guide plate 16, is smaller than the first bearing 12 although the inner diameter of the inner wheel 153 thereof is same as that of the first bearing 12. However, the second bearing 15 is of substantially the same type and for example, it is permissible to select an ordinary marketed bearing in which a plurality of steel balls 152 are loaded between an outer wheel 151 and the inner wheel 153 appropriately for usage. In the meantime, if the second guide plate 16 is fixed to the spindle 11 and rotates synchronously with the spindle 11, when it makes contact with the edge 72 of the material 70, chipping or the like occurs on the edge so that the material 70 is damaged. Further, the outer peripheral end face 161 of the second guide plate 16 itself is worn, so that the grinding distance (grinding depth) Y cannot be controlled. A circular spacer 14 is attached to the first spindle main body 102 between the first guide plate 13 and the second guide plate 16, the space 14 being interposed between bearings fitted to the first guide plate 13 and the second guide plate 16, that is, the first bearing 12 and the second bearing 15 so as to specify a distance between the first guide plate 13 and the second guide plate 16 and make contact with the inner wheels of the respective bearings to block an interference between the both, thereby enabling the respective bearings to function as independent guides.

Cut-out portions 187, which are connected to the cut-out grooves 185 formed in the grinding face, are formed radiantly in the diameter direction in a contact surface of the profile wheel 18 to the second guide plate 16. At the time of wet grinding, the cut-out portions 187 serve as a supply path of grinding water supplied from the front end of the spindle of the electric tool to the grinding face 181 of the profile wheel 18 through the interior of the spindle 11 and water supply ports 105 of the spindle 11 and are arbitrary components.

In the constant angular tool 10 of this embodiment, to the spindle 11 of each hand held electric tool are attached the disc-like first guide plate 13 in which the first bearing 12 is fitted to the fitting hole 132 of the inside diameter thereof, the spacer 14, the disc-like second guide plate 16 in which the second bearing 15 is fitted to the fitting hole 163 of the inside diameter thereof and the profile wheel 18 whose grinding face 181 is formed at a predetermined inclination angle X to the center of axis, that is, 45° in this example, in this order, such that they are perpendicular to the axis of the spindle 11. After that, they are fixed to the spindle located outside with the lock nut 20 via a washer 19.

Figure 9:
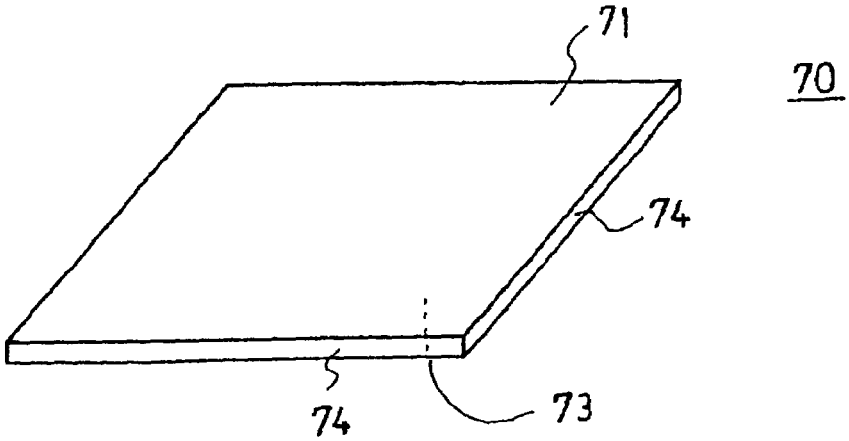
FIG. 9 is a perspective view showing schematically JIS standard tile used in the embodiment.
Figure 10:
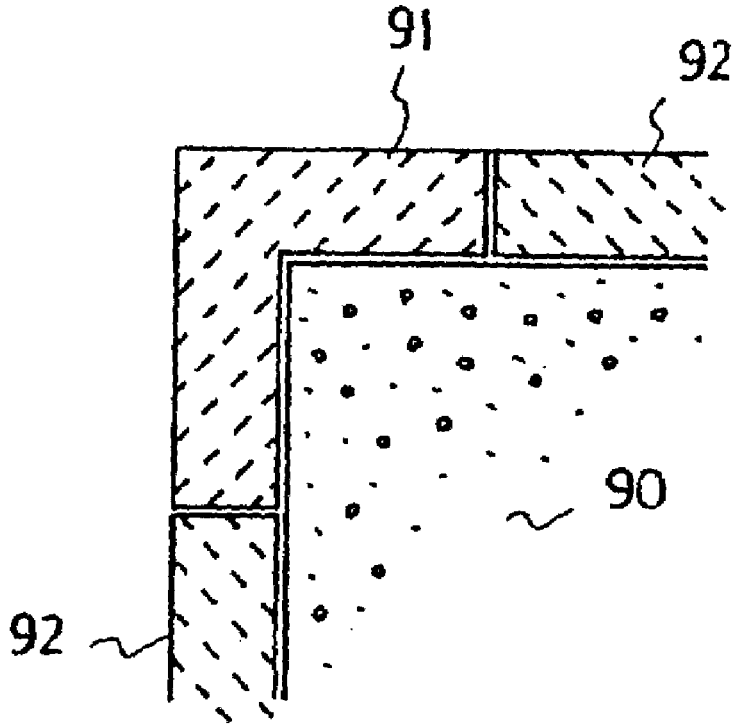
FIG. 10 is a partially enlarged sectional diagram showing a state in which exterior work is carried out on the right angle corner of the existing wall face using marketed special corner piece material.
Figure 11:
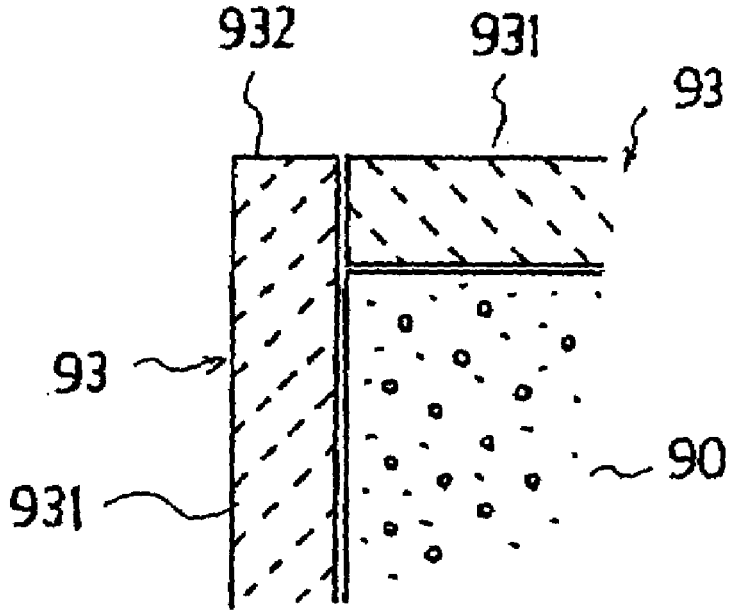
FIG. 11 is a partially enlarged sectional view showing a state in which exterior work is carried out on the right angle corner of the existing wall face by a means implemented conventionally for some sections.

An example of a method for grinding the edge 72 of the material 70 at a specified angle using the constant angular grinding tool is shown here. As the material 70, various kinds of burnt tile, various kinds of natural stones, engineered stone and the like can be mentioned. More specifically, as shown in FIG. 9, square JIS standard construction material tile and natural stone 7–13 mm thick and 300 mm square or 600 mm square as a large size, and processed materials of various shapes such as large-size tiles and small-size tiles can be mentioned. The surface of the tile is subjected to coating with an ordinary glaze and the natural stone is polished. First, the material 70 with its surface 71 facing upward is fixed on a grinding jig 80 having a horizontal plane. With the switch of the electric tool ON, the flat edge 131 of the first guide plate 13 is brought into contact with the reference level (surface) 71 of the material so as to determine the positional relation between the material 70 and the rotary electric tool (FIG. 6). Next, with the edge 131 of the first guide plate 13 and the grinding direction (arrow Z in the same Figure) kept in parallel, grinding processing is carried out. Because at this time, the first guide plate 13 is kept static on the reference level 71 of the material without being affected by the rotation of the spindle 11, the grinding direction of the profile wheel 18 can be kept constant with respect to the grinding direction. Then, because the outer peripheral end face 161 of the second guide plate 16 makes contact with the edge 72 of the material as the grinding proceeds from the edge 72 of the material in the direction to the center of the material, progress in the direction to the depth side of the profile wheel 18 is stopped. On the other hand, as for grinding method for grinding in a direction along the edge 72 at right angle to the depth side direction (direction at right angle to the paper of FIG. 7), grinding is carried out both way from an appropriate position at an appropriate distance and this procedure is executed while moving the tool. According to this grinding method, accurate, stable inclined angle and inclined face (slope) can be obtained repeatedly without any special operation. Further, even if the second guide plate 16 makes contact with the edge 72 of the material, the rotation of the spindle 11 is not influenced and static condition is maintained, thereby facilitating grinding without any hand movement.

EXAMPLE 1

A marketed hand-held disc grinder was prepared and as shown in FIGS. 1 to 4, the respective members were mounted on and fixed to a multi-stage spindle 11 of the grinder so as to construct a constant angular grinding tool 10. More specifically, to a first spindle main body 102 having an outside diameter of 20.0 mm were attached a first guide plate 13 made of resin and having an outside diameter of 96.2 mm and a thickness of 7.5 mm, in which a first bearing 12 was fitted to a bearing fitting hole 132, and a second guide plate 16 having an outside diameter of 51.0 mm and an outside disc thickness of 3.5 mm, in which a second bearing 15 was fitted to a bearing fitting hole 163. At this time, a ring-like spacer 14 having an outside diameter of 25.4 mm and a thickness of 1.0 mm was attached to the first spindle main body 102 between the both in order to maintain a specified distance. Then, a profile wheel 18 whose grinding face was formed at 45° with respect to the axis was attached to the second spindle main body 103 having an outside diameter of 17.0 mm and fixed to the spindle 11 with a state perpendicular to its axis by tightening a lock nut 20 fitted to a male screw portion 20 through a washer 19. At this time, the inner wheel 123 of the first bearing 12 mounted on the first spindle main body 102 made contact with the base portion 101 of the spindle 11 and the spacer 14, the inner wheel 153 of the second bearing 15, the profile wheel 18 mounted on the second spindle main body 103 and the washer 19 were attached such that they keep contact with each other in this order and fixed firmly by tightening the lock nut 20 fitted to the male screw portion 104 and then, a constant angular grinding tool 10 whose specified inclined angle X was formed to 45° was completed. In the meantime, the grinding face of the profile wheel 18 had a maximum outside diameter of 72.5 mm, a minimum outside diameter of 50.0 mm and a width of 13.25 mm and a grinding stone section 184 composed of diamond abrasive layer was formed on the grinding face 181 and six cut-out grooves 185 having a width of 4.0 mm were formed in the grinding stone portion 184 radiantly toward the outer periphery from the axis.

Figure 8:
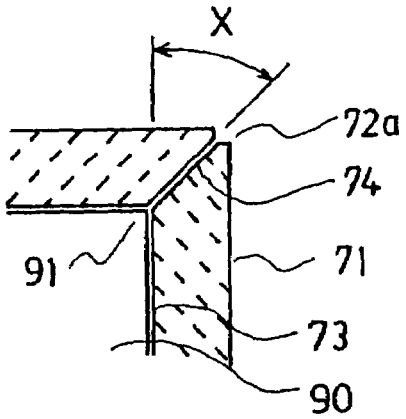
FIG. 8 is a partially enlarged diagram showing schematically a state in which exterior work is carried out on a right angle corner of an existing wall face by butting two materials obtained in the embodiment.

A plurality of JIS standard tile materials 70 of 10 mm in thickness and 300 mm square as shown in FIG. 9 were prepared and then, edge processing at 45 □ to the tile material 70 was implemented with the constant angular grinding tool 10 with the surface 71 of the tile material 70 and the edge 74 continued from it as each reference level. This grinding processing was carried out by not as skilled a worker having a high grade capability but a relatively unskilled worker trained in a specified course. With the side face 131 of the first guide plate 13 of the constant angular grinding tool 10 kept in contact with the surface 71 of the tile material 70 fixed on a flat top face of a grinding jig 80 as shown in FIG. 6, an electric tool was turned to ON and then grinding of the edge 72 of the tile material was started. Due to the operation of the first bearing 12 fitted to the first guide plate 13, the first guide plate 13 maintained horizontality to the reference level 71 of the tile material 70 in a stable condition regardless of an electric tool rotating at high speeds and the grinding was progressed extremely favorably and finally, the outer peripheral end face 161 of the second guide plate 16 reached at the edge 72 of the tile material 70 as shown in FIG. 7 and the progress of the grinding was stopped when it reached. Consequently, a grinding distance of 10.75 mm from the side end face (reference level) of the tile material edge 72 was determined. As a result of implementing the edge processing of the plurality of tile materials 70 in this way and butting the processed edges with each other, it was recognized that these could cover the right angle corner 91 on the existing wall face 90 sufficiently as shown in FIG. 8. In the meantime, although there was left a non-ground belt 72*a* (non-processed portion) having a width of 2.0 mm on the edge 72 of the tile material 70, such an extent of the non-ground portion did not damage the appearance in terms of design.

Because the constant angular grinding tool 10 was capable of grinding a joint edge of tile material used for exterior construction on a right corner of the existing wall accurately and at a good balance with an inclination angle of 45° and a specified grinding distance of Y regardless of such a simple structure in which the first guide plate 13 and the second guide plate 16 are added to a conventional grinding tool, it was confirmed that it functioned extremely effectively. Further, no skilled worker having any special high level capability was necessary for grinding work on construction site and a worker trained in a specified course could implement the side face processing stably and effectively in a relatively easy way. Further, because the constant angular grinding tool 10 allows the processing to be carried out with the first guide plate placed on the reference level of material, even an unskilled worker could handle an electric tool rotating at high speeds and continue the work with safety.

INDUSTRAIL APPLICABILITY

Because when an existing wall surface formed with various kinds of panels is covered with sheet materials such as tiles, natural stones, for example, granite, marble, engineered stone and the like, the constant angular grinding tool of the present invention processes these exterior construction material such as said tiles along a right angle corner of the existing wall surface, this is useful as a tool for grinding the edge of the exterior construction material such as the tiles accurately with an angle of 45°. Further, because the inclination angle X of the constant angular grinding tool of the present invention can be changed freely depending on the angle of the grinding face of the profile wheel for use, it is expected to be used for wider applications, for example, wall surfaces having various corner angles.

The invention claimed is:

1. A constant angular grinding tool comprising:

a profile wheel whose grinding face is formed with a predetermined inclination angle extending from a front face thereof to a new face thereof with respect to the axis of a spindle of a rotary electric tool;

a first guide plate which is a disc member attached rotatably to a spindle between said profile wheel and said rotary electric tool so as to guide for a grinding direction by bringing the edge of the disc member into a contact with the reference level of a material to control the inclination angle; and a second guide plate which is a disc member attached rotatably to a spindle between said first guide plate and said profile wheel and whose outer peripheral end face makes contact with the edge of said material to control a grinding distance from the edge, wherein said profile wheel, the first guide plate and the second guide plate are fixed to the spindle of said rotary electric tool with a lock nut such that they are perpendicular thereto, and wherein said first guide plate is a disc member having a bearing fitting hole in the center thereof and larger than the maximum diameter of the grinding face of said profile wheel and mounting thereof to the spindle of said rotary electric tool is carried out through a first bearing fitted to the bearing fitting hole for mounting said first guide plate to the spindle.

2. The constant angular grinding tool according to claim 1 wherein said second guide plate is a disc member having a bearing fitting hole in the center thereof and having an outside diameter substantially equal to the minimum diameter of said profile wheel and a second bearing fitted to the bearing fitting hole for mounting said rotary electric tool to the spindle.

3. The constant angular grinding tool according to claim 1 wherein the grinding face of said profile wheel is formed at an inclination angle of 45° with respect to the axis of the spindle of said rotary electric tool and an ultra-abrasive portion composed of CBN abrasive brazing or diamond abrasive brazing is formed on the grinding face.

4. A constant angular grinding tool according to claim 1 wherein a plurality of cut-out portions are formed radiantly in the abrasive coating portion of said profile wheel from the axis to the outer periphery.

5. The constant angular grinding tool according to claim 1 wherein said first guide plate and second guide plate are manufactured of metal, resin or composite material thereof.

6. A constant angular grinding tool according to claim 1 wherein flow paths for grinding fluid supplied to the grinding face of said profile wheel are provided in a contact face of said profile wheel to the second guide plate.

* * * * *